US010371389B2

(12) United States Patent
Yang et al.

(10) Patent No.: US 10,371,389 B2
(45) Date of Patent: Aug. 6, 2019

(54) COOKING DEVICE

(71) Applicant: Samsung Electronics Co., Ltd, Gyeonggi-do (KR)

(72) Inventors: Gi-young Yang, Gyeonggi-do (KR); Si-ho Jang, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 366 days.

(21) Appl. No.: 15/186,301

(22) Filed: Jun. 17, 2016

(65) Prior Publication Data

US 2017/0016630 A1 Jan. 19, 2017

(30) Foreign Application Priority Data

Jul. 13, 2015 (KR) ..... 10-2015-0099336

(51) Int. Cl.
*F24C 15/20* (2006.01)

(52) U.S. Cl.
CPC ..... *F24C 15/2042* (2013.01); *F24C 15/2021* (2013.01); *F24C 15/2085* (2013.01); *F24C 15/2092* (2013.01)

(58) Field of Classification Search
USPC ..... 126/299 D
See application file for complete search history.

(56) References Cited

U.S. PATENT DOCUMENTS 108,082 A * 10/1870 Abbott ..... F24C 15/2085 126/301
173,294 A * 2/1876 Hockman ..... F24C 15/2085 126/301
204,819 A * 6/1878 Harding ..... F24C 15/2085 126/301
208,891 A * 10/1878 Cromer ..... F24C 15/2085 126/301
245,689 A * 8/1881 Young ..... F24C 15/2085 126/301
286,643 A * 10/1883 Schwibinger ..... F24C 15/2085 126/301

(Continued)

FOREIGN PATENT DOCUMENTS

EP 1296096 A2 * 9/2002
JP 11-294818 10/1999

(Continued)

OTHER PUBLICATIONS

Machine translation of JP2005106374A, see file "JP2005106374 wipo translate.pdf".*

(Continued)

*Primary Examiner* — Avinash A Savani
*Assistant Examiner* — Martha M Becton

(57) ABSTRACT

A cooking device is provided, which includes a cooking portion, a hood portion arranged on the cooking portion and provided with a suction port formed on one side thereof, and a driving portion configured to move the hood portion, wherein the hood portion is movable to any one of a first position in which the hood portion is accommodated in the cooking portion and a second position in which the hood portion projects from the cooking portion, and an angle of the hood portion is varied so as to change a direction in which the suction port is directed in the second position.

16 Claims, 17 Drawing Sheets

(56) References Cited

U.S. PATENT DOCUMENTS 368,231 A * 8/1887 Parks ..... F24C 15/2085 126/301
369,161 A * 8/1887 Carlson ..... F24C 15/2085 126/301
399,430 A * 3/1889 Neef ..... F24C 15/2085 126/301
481,901 A * 8/1892 Fowler ..... F24C 15/20 126/301
495,141 A * 4/1893 Norton ..... F24C 15/2085 126/301
514,003 A * 2/1894 Hornor ..... F24C 15/2092 126/301
913,465 A * 2/1909 Brouillet ..... F24C 15/2092 126/299 D
996,554 A * 6/1911 Baldwin ..... D06F 1/06 126/299 D
2,554,694 A * 5/1951 Belt ..... A47J 36/38 126/299 R
2,968,231 A * 1/1961 Tygard ..... F24C 15/2092 126/299 D
2,974,663 A * 3/1961 Humbert ..... F24C 15/2042 126/299 R
3,102,533 A * 9/1963 Jenn ..... F24C 15/12 126/303
3,537,442 A * 11/1970 Berger ..... F24C 15/2042 126/21 R
4,446,849 A * 5/1984 McFarland ..... F24C 15/2042 126/299 R
4,446,861 A * 5/1984 Tada ..... A61C 19/00 128/863
4,501,260 A * 2/1985 Grace ..... F24C 15/2092 126/21 R
4,612,909 A * 9/1986 Lee ..... F24C 15/2085 126/299 D
6,604,520 B2 * 8/2003 Grimm ..... F24C 15/2042 126/299 D
6,647,978 B1 * 11/2003 Khosropour ..... F24C 15/2085 126/299 D
6,877,506 B2 * 4/2005 Shekarri ..... F24C 15/2021 108/106
6,886,554 B2 * 5/2005 Cheng ..... F24C 15/2078 126/299 D
10,041,687 B1 * 8/2018 Caneba ..... F24C 15/20
2002/0029696 A1 * 3/2002 Grimm ..... F24C 15/2042 99/403
2003/0226558 A1 * 12/2003 Khosropour ..... F24C 15/2085 126/299 R
2003/0226560 A1 * 12/2003 Shekarri ..... F24C 15/2021 126/299 R
2004/0206348 A1 * 10/2004 Bourassa ..... F24C 15/2092 126/299 R
2006/0231553 A1 * 10/2006 Gerami ..... B08B 15/02 219/757
2007/0079823 A1 * 4/2007 Shin ..... F24C 15/2085 126/299 D
2010/0065038 A1 * 3/2010 Davies ..... F24C 15/2042 126/299 D
2015/0330641 A1 * 11/2015 Lillesand ..... F24C 15/2085 126/299 D

FOREIGN PATENT DOCUMENTS

JP 2003-310359 11/2003
JP 2005-030728 2/2005
JP 2005106374 A * 4/2005 ..... F24C 15/2042

OTHER PUBLICATIONS

Machine translation of EP1296096A2, see file "ep1296096 wipo translate.pdf".*

* cited by examiner

COOKING DEVICE

CROSS-REFERENCE TO RELATED APPLICATIONS AND CLAIM OF PRIORITY

The present application is related to and claims benefit of Korean Patent Application No. 10-2015-0099336 filed on Jul. 13, 2015 in the Korean Intellectual Property Office, the disclosure of which is incorporated herein by reference in its entirety.

TECHNICAL FIELD

The present disclosure relates to a cooking device, and more particularly, to a cooking device which enables a hood portion to move in accordance with user's intention.

BACKGROUND

In general, a hood portion is arranged on an upper side of a cooking portion that includes a gas range or an electric range to inhale cooking smell and smoke generated when food is cooked.

However, in the related art, the hood portion is fixedly arranged on the upper side of the cooking portion, and in the case of cooking food using a cooking vessel having a small size or a cooking vessel having a low height, such as a frypan, the distance between the hood portion and the cooking vessel becomes far, and this causes the hood portion to be unable to effectively inhale the cooking smell and smoke.

As a scheme to solve this problem, the hood portion may be arranged close to the cooking portion. In this case, however, a cooking space that is required when a user cooks food in front of the cooking portion cannot be properly secured. Further, such an arrangement of the hood portion close to the cooking portion may spoil the appearance of the cooking portion.

To resolve this, a scheme has recently been proposed, in which a hood portion that is movable upward and downward is arranged on the ceiling. In this case, while the food is cooked, the hood portion moves downward to inhale the cooking smell and smoke, whereas when the cooking is completed, the hood portion moves upward to be located adjacent to the ceiling. However, in the case of the hood portion that is arranged on the ceiling, a driving portion that drives the hood portion upward and downward transfers a driving power to the hood portion mainly through a wire, and thus upward/downward movement of the hood portion may become unstable.

Further, an island type cooking portion may be arranged roughly in the center of or on one side of a kitchen, being separated from a general cooking portion, and in this case, it is required to additionally provide a hood portion for the island type cooking portion on the ceiling, and this may cause the installation thereof to be troublesome.

SUMMARY

To address the above-discussed deficiencies, it is a primary object to provide a cooking device which enables a hood portion to be arranged adjacent to a cooking portion only in the case of using the hood portion and thus can heighten space utilization.

Further, exemplary embodiments of the present disclosure provide a cooking device which not only enables a hood portion to be arranged adjacent to a cooking vessel that is put on a cooking portion through upward/downward movement of the hood portion but also can adjust a direction in which the hood portion is directed in accordance with a user's need in a state where the hood portion is arranged adjacent to the cooking vessel.

According to an aspect of the present disclosure, a cooking device includes a cooking portion; a hood portion arranged on the cooking portion and provided with a suction port formed on one side thereof; and a driving portion configured to move the hood portion, wherein the hood portion is movable to any one of a first position in which the hood portion is accommodated in the cooking portion and a second position in which the hood portion projects from the cooking portion, and an angle of the hood portion is varied so as to change a direction in which the suction port is directed in the second position.

An angle of the suction port of the hood portion against the cooking portion may be changed in the range of 0° to 90°.

The hood portion may be hingedly connected to a part of the driving portion.

The hood portion may be movable to a third position that is between the first position and the second position.

The angle of the hood portion may be varied so as to change the direction in which the suction port is directed in the third position.

The driving portion includes a first driving portion configured to move the hood portion to the first position and the second position; and a second driving portion configured to change the direction in which the suction port is directed.

The first driving portion includes a driving source configured to generate a driving power; and a worm gear configured to receive the driving power that is transferred from the driving source and to move the hood portion.

The first driving portion further includes a guide shaft configured to guide movement of the hood portion.

The hood portion is provided with a distance sensor arranged adjacent to the suction port to measure a distance between the suction port and a cooking vessel that is put on the cooking portion, and the distance sensor includes a warning portion configured to warn a user when the distance between the suction port and the cooking vessel reaches a predetermined distance.

The warning portion is a display or a sound portion.

The hood portion further includes a display configured to display the distance between the suction port and the cooking vessel, which is measured by the distance sensor, to the user.

The cooking portion further includes a cover configured to cover the hood portion so that the hood portion is not exposed to an outside when the hood portion is in the first position.

The hood portion further includes an illuminator arranged toward the cooking portion.

A suction force at the suction port is adjustable.

According to another aspect of the present disclosure, a cooking device includes a cooking portion; a hood portion provided with a suction port formed on one side thereof and configured to be movable to any one of a first position in which a suction mode for inhaling polluted air that is generated from the cooking portion through the suction port is not performed and a second position in which the suction mode is performed; and a driving portion configured to move the hood portion, wherein an angle of the hood portion is varied so as to change a direction in which the suction port is directed in the second position, the hood portion is arranged on a ceiling, is positioned adjacent to the ceiling in the first position, and descends by the driving portion to move to the second position in which the hood portion is adjacent to the cooking portion, and the driving portion includes a first driving portion configured to move the hood portion to the first position and the second position and a second driving portion configured to change the direction in which the suction port is directed.

The first driving portion includes a driving source configured to generate a driving power; and a worm gear configured to receive the driving power that is transferred from the driving source and to move the hood portion.

Additional and/or other aspects and advantages of the disclosure will be set forth in part in the description which follows and, in part, will be obvious from the description, or is learned by practice of the disclosure.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
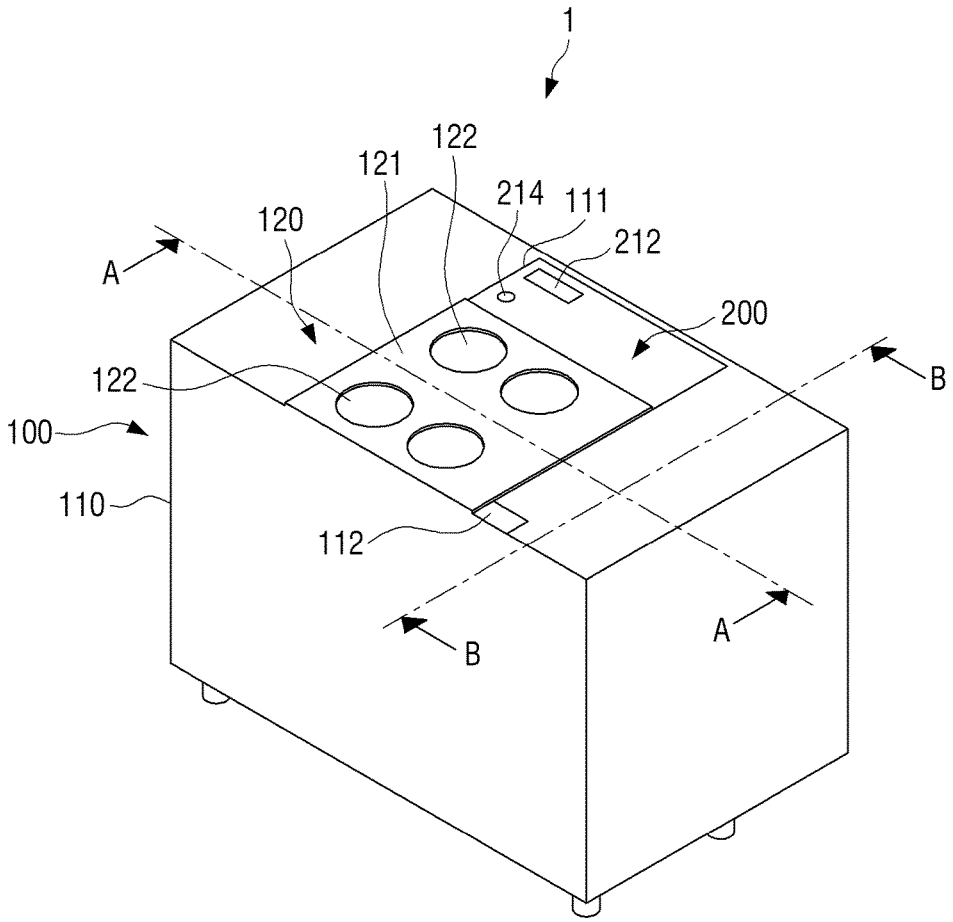
FIG. 1 illustrates a first position of a cooking device according to a first embodiment of the present disclosure.
Figure 2:
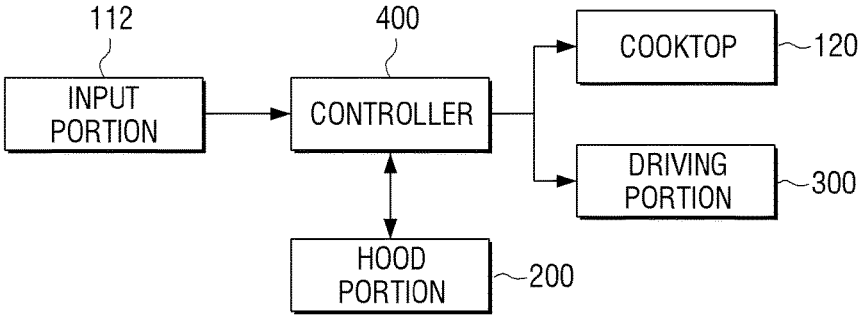
FIG. 2 illustrates a control construction installed in a cooking device according to a first embodiment of the present disclosure.
Figure 3:
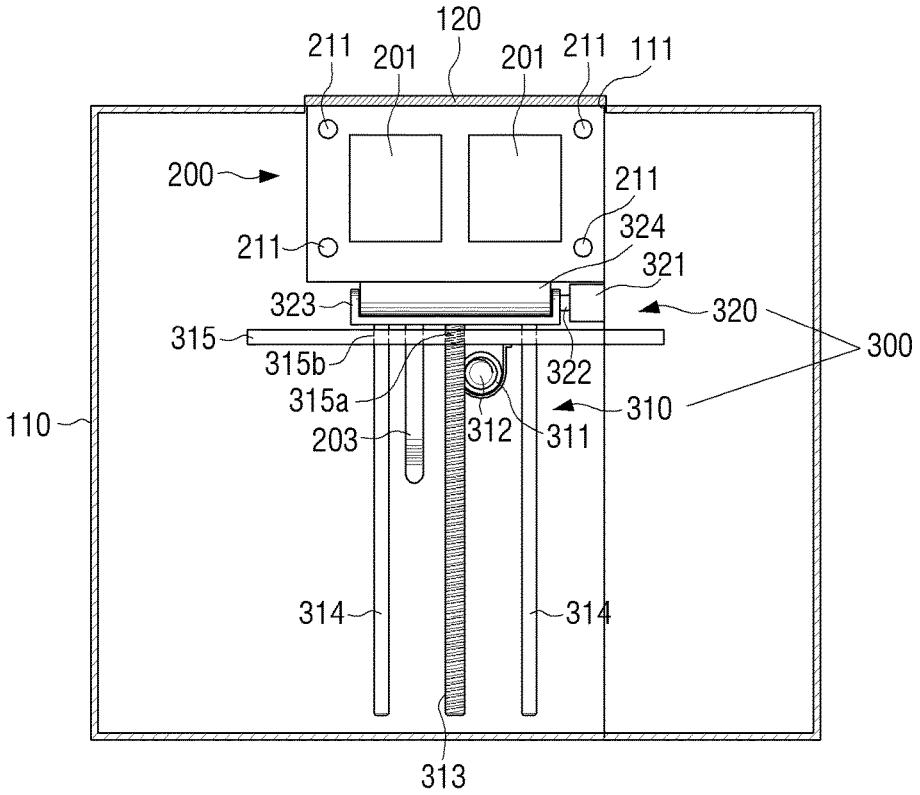
FIG. 3 illustrates a cross-sectional view taken along line A-A indicated in FIG. 1 according to the various embodiments of the present disclosure.
Figure 4:
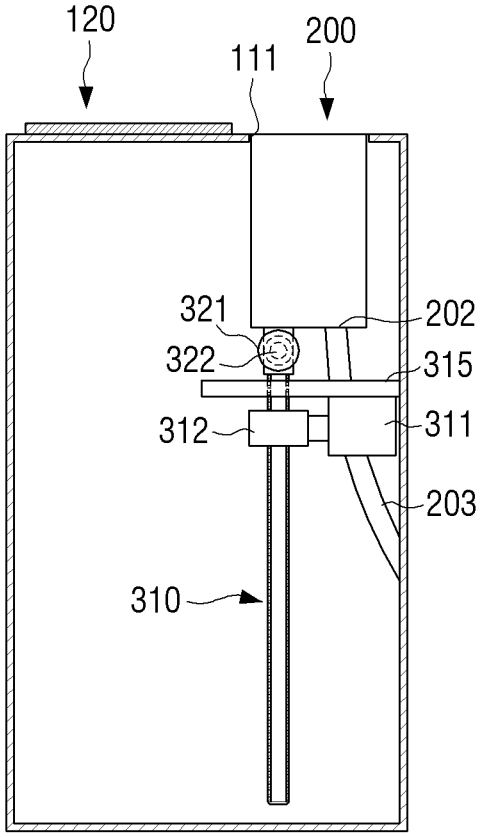
FIG. 4 *i* illustrates s a cross-sectional view taken along line B-B indicated in FIG. 1 according to the various embodiments of the present disclosure.

FIGS. 1 through 17, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device.

Hereinafter, exemplary embodiments of the present disclosure will be described in detail with reference to the accompanying drawings. However, in describing the embodiments of the present disclosure, a detailed description of known constructions or functions will be omitted if it is deemed that such description would make the gist of the present disclosure unnecessarily vague. Further, in the drawings, to help the understanding of the present disclosure, sizes of some constituent elements may be exaggerated for clarity in explanation.

Referring to FIGS. 1 to 4, a cooking device 1 according to an embodiment of the present disclosure includes a cooking portion 100, a hood portion 200, a driving portion 300, and a controller 400.

Referring to FIG. 1, the cooking portion 100 is a portion on which a user cooks food, and is roughly in a rectangular shape, but is not limited thereto. The cooking portion 100 is formed in various shapes, such as hemispheric and octahedral shapes. The cooking portion 100 is of a general type that is fixedly arranged on one side of a kitchen, or of an island type that is arranged roughly in the center portion of the kitchen. The cooking portion 100 includes a housing 110 and a cooktop 120.

The housing 110 forms the external appearance of the cooking portion 100, and as described above, is roughly in a rectangular shape, but is not limited thereto. The housing 110 is formed in various shapes, such as hemispheric and octahedral shapes. In addition, an accommodation space (not illustrated) is provided in the housing 110.

The cooktop 120 is arranged on a part of an upper surface of the housing 110, and the hood portion 200 and the driving portion 300 to be described later are arranged in the housing 110. In this case, a hood portion passing hole 111 is formed on one surface of the housing 110 so that the hood portion 200 can move to a position in which the hood portion 200 projects out of the housing 110.

Figure 5:
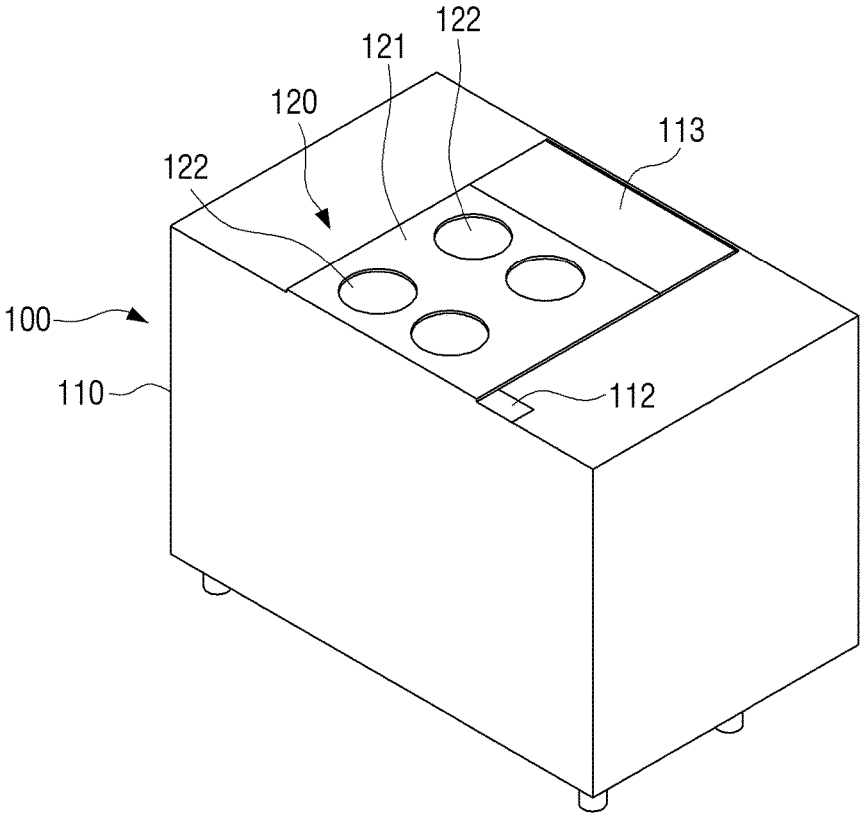
FIG. 5 illustrates a case where the cooking device of FIG. 1 includes a cover.

In addition, referring to FIG. 5, on a portion where the hood portion passing hole 111 is formed, a cover 113, which is hingedly connected to one side of the housing 110 to be opened or closed corresponding to the movement of the hood portion 200, is provided. Accordingly, when the hood portion 200 is in a first position, the cover 113 covers the hood portion 200 to protect the hood portion 200. In this case, the cover 113 may have the same material and color as those of the housing 110 to provide a design effect.

Further, on one surface of the housing 110, an input portion 112, which is connected to the controller 400 and through which a user can input a command for controlling the cooking device 1, is arranged. In consideration of user's convenience in use, it is preferable that the input portion 112 is provided on a part of an upper surface or a front surface of the housing 110.

In addition, on a lower end portion of the housing 110, wheels (not illustrated) are provided so that a user can easily move the cooking portion 100 in order to change the position of the cooking portion 100.

The cooktop 120 is a place on which a user puts a cooking vessel (not illustrated) to cook food, and includes a cooking table 121 and at least one heating device 122.

The cooking table 121 is arranged on a part of the upper surface of the housing 110 and is in the form of a flat plate on which the cooking vessel can be put. The cooking table 121 is made of a tempered glass material so that it is not easily broken or scratched.

The at least one heating device 122 is arranged on a lower portion of the cooking table 121. Although FIG. 1 illustrates that four heating devices 122 are provided, the number of heating devices 122 is not limited thereto, but is variously set as needed. In addition, the heating device 122 is an electric range that performs heating using electricity or a gas range using a gas.

Figure 6:
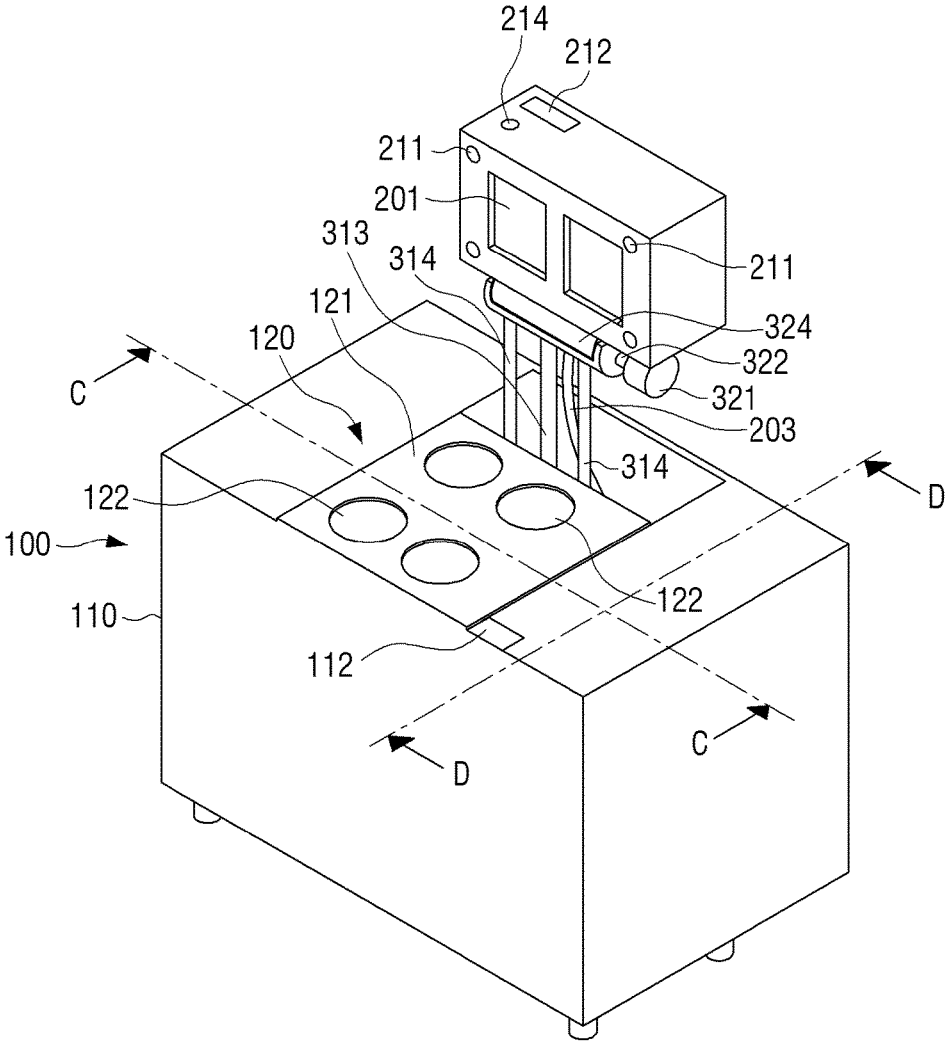
FIG. 6 illustrates a second position of a cooking device according to a first embodiment of the present disclosure.

In a standby mode in which a suction mode for inhaling cooking smell and smoke is not performed, the hood portion 200 is in a first position in which the hood portion 200 is accommodated in the housing 110 as illustrated in FIG. 1, while in the suction mode, the hood portion 200 is in a second position in which the hood portion 200 projects out of the housing 110 as illustrated in FIG. 6. Specifically, the hood portion 200 is connected to the driving portion 300 to be described later to be movable to any one of the first position and the second position by the driving portion 300. The hood portion 200 includes a suction port 201, a discharge port 202, an illuminator 211, a display 212, a distance sensor 213, and a warning portion 214.

The suction port 201 is formed on a part of the hood portion 200 to inhale the cooking smell and smoke generated from the cooktop 120. A filter (not illustrated) for filtering polluted air is provided in the suction port 201. In addition, referring to FIG. 3, it is exemplified that the cooking device 1 according to an embodiment of the present disclosure has two suction ports 201, but is not limited thereto. It is also possible that the hood portion 200 includes one large suction port or three or more suction ports formed thereon.

The discharge port 202 is formed on another part that is different from the part where the suction port 201 of the hood portion 200 is formed, and is connected to a discharge pipe 203 to discharge the cooking smell and smoke inhaled through the suction port 201 to the outside. In this case, it is preferable that the discharge port 202 is formed on the side surface that faces the suction port 201 of the hood portion 200 in order to efficiently discharge the cooking smell and smoke inhaled through the suction port 201. In addition, the discharge pipe 203 penetrates the housing 110 of the cooking portion 100 to be connected to the outside.

Further, between air flow paths of the suction port 201 and the discharge port 202 of the hood portion 200, a driving fan (not illustrated) for generating a suction force in the suction port 201 is provided. Through the driving fan, the hood portion 200 can inhale and discharge the cooking smell and smoke generated from the cooktop 120 of the cooking portion 100 to the outside.

The illuminator 211 is formed adjacent to the suction port 201 to provide light so that the cooking vessel can be seen well when the food is cooked.

The display 212 is formed on a part of the front surface of the hood portion 200 and visually provides the user with information on the suction mode when the hood portion 200 is in the second position.

Specifically, the display 212 can display the current degree of the suction force of the suction port 201 to the user, and thus the user, who has confirmed this, can adjust the suction force of the suction port 201 through the input portion 112. Further, in the case where the user sets an operating time of the hood portion 200 through the input portion 112, the display 212 can display the remaining operating time of the hood portion 200 to the user. In addition, the display 212 displays the distance between the suction port 201 and the cooking vessel, which is measured by the distance sensor 213 to be described later, to the user.

The distance sensor 213 is arranged adjacent to the suction port 201 to face the cooktop 120 when the hood portion 200 is in the second position. The distance sensor 213 measures the distance between the suction port 201 and the cooking vessel and transfers information on the measured distance to the controller 400.

The warning portion 214 is provided on the hood portion 200, and if the distance measured by the distance sensor 213 becomes shorter than a predetermined distance, the warning portion 214 warns the user of this. The warning portion 214 is a sound portion that can aurally give warning to the user or a display that can visually give warning to the user. In addition, it is also possible to warn the user through the above-described display 212 without using a separate warning portion 214.

The driving portion 300 moves the hood portion 200 and includes a first driving portion 310 and a second driving portion 320.

Figure 7:
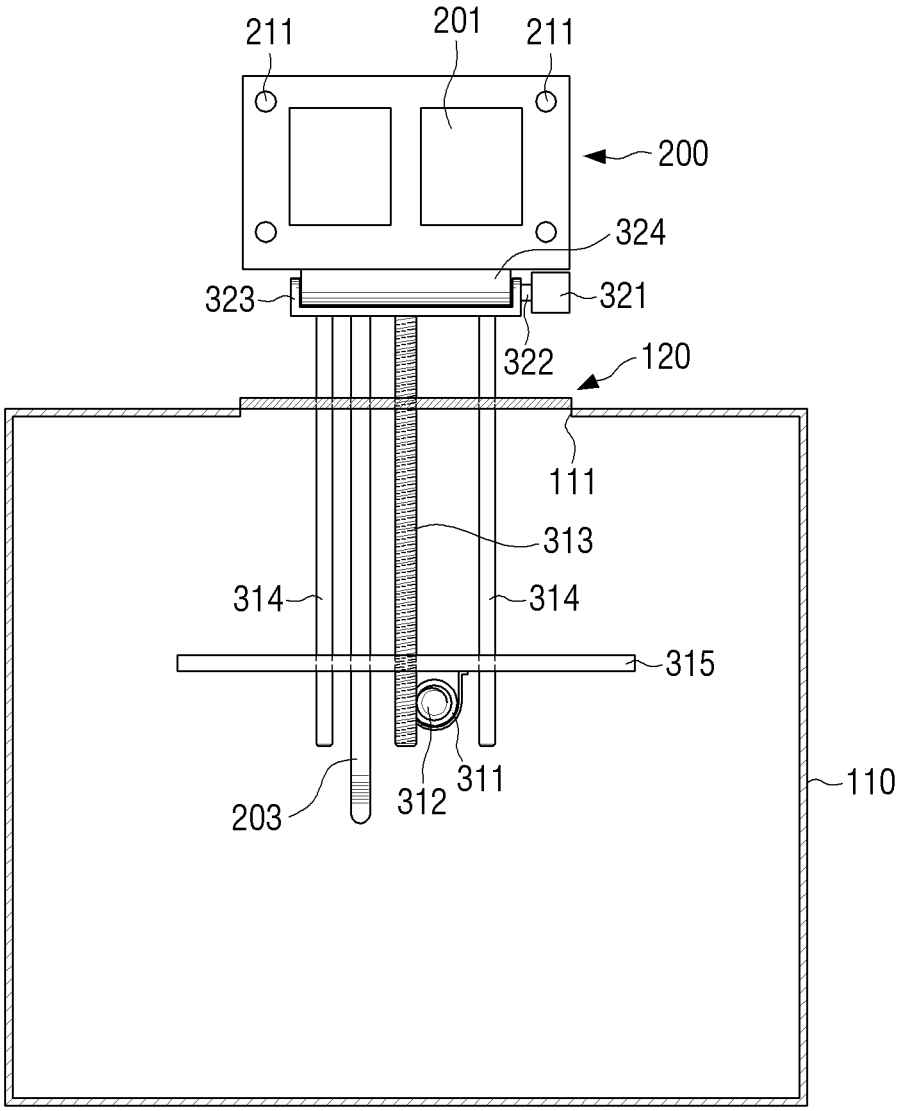
FIG. 7 illustrates a cross-sectional view taken along line C-C indicated in FIG. 6 according to the various embodiments of the present disclosure.
Figure 8:
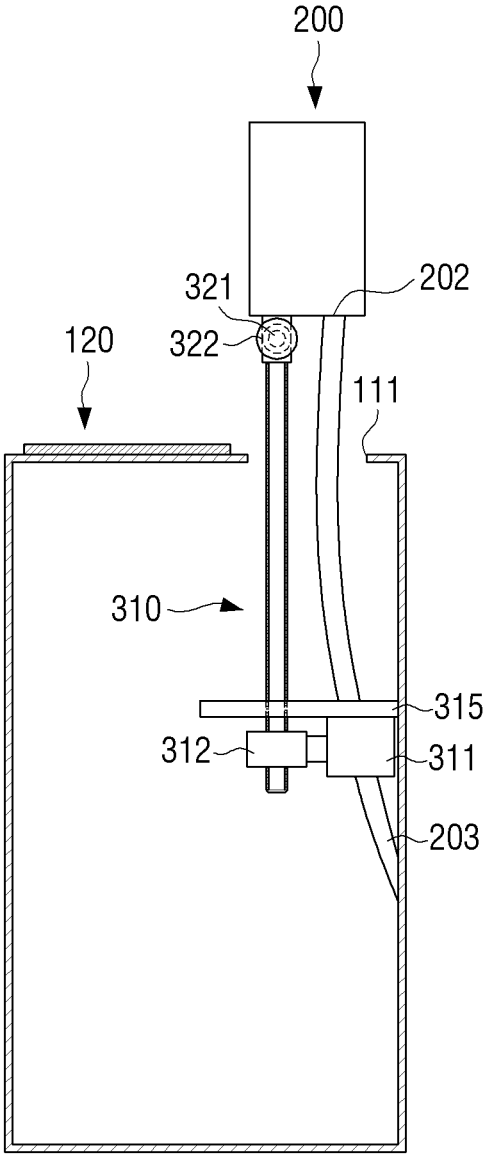
FIG. 8 illustrates a cross-sectional view taken along line D-D indicated in FIG. 6 according to the various embodiments of the present disclosure.

Referring to FIGS. 6 to 8, the first driving portion 310 moves the hood portion 200 to the first position and the second position, and includes a first driving source 311, a power transfer portion 312, a main gear 313, a guide shaft 314, and a guide portion 315.

The first driving portion 311 generates a driving power to move the hood portion 200 to the first position and the second position, and is fixedly provided on the guide portion 315, but is not limited thereto. The first driving portion 311 is fixedly provided on a bottom surface of the housing by a support (not illustrated).

The power transfer portion 312 connects the first driving source 311 and the main gear 313 to each other to transfer the driving power that is generated from the first driving source 311 to the main gear 313. The power transfer portion 312 is any one that can transfer the driving power that is generated by the first driving source 311 to the main gear 313, such as a timing belt or a gear.

The main gear 313 is rotatably engaged with a main gear hole 315*a* of the guide portion 315, receives the driving power that is transferred from the first driving source 311 through the power transfer portion 312, and moves the hood portion 200 in upward/downward directions. That is, the main gear 313 can move the hood portion 200 to any one of the first position in which the hood portion 200 is accommodated in the cooking portion 100 and the second position in which the hood portion 200 projects from the cooking portion 100. As the main gear 313 as described above, a worm gear that extends long in the upward/downward directions is used.

Figure 13:
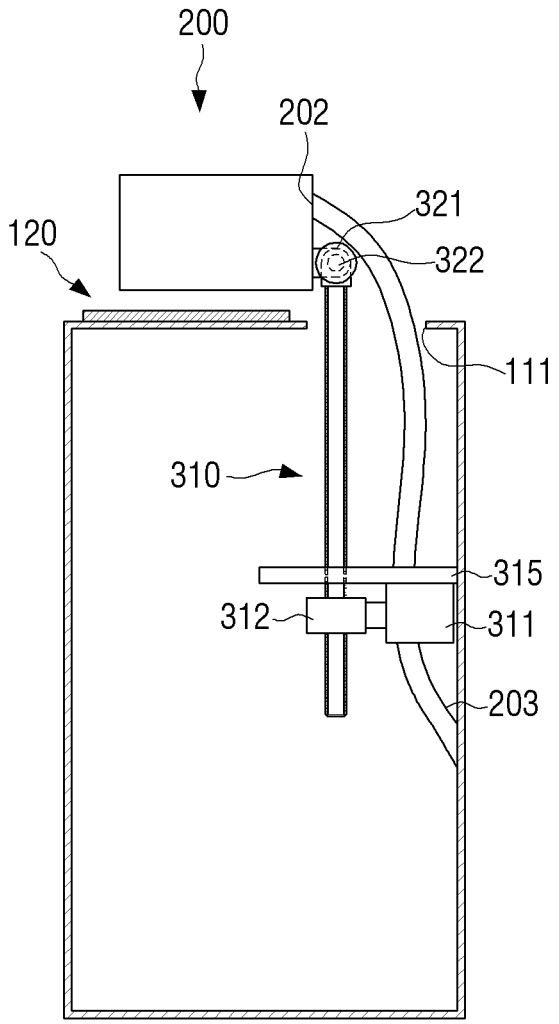
FIG. 13 illustrates a case where a hood portion illustrated in FIG. 12 is in a third position according to the various embodiments of the present disclosure.

In addition, referring to FIG. 13, the main gear 313 can move the hood portion 200 to a third position that is between the first position and the second position in accordance with a user's intention.

Specifically, the second position of the hood portion 200 is set with a height enough to inhale the cooking smell and smoke even in the case of cooking food using a large cooking vessel. In this case, however, it is not possible to efficiently inhale the cooking smell and smoke in the case of a cooking vessel having a low height, such as a frypan, or a cooking vessel having a small size, and in consideration of this, the user can move the hood portion 200 to the third position having a height that is lower than the height of the second position through the main gear 313.

The guide shaft 314 is slidably coupled to a guide shaft hole 315*b* of the guide portion 315 in upward/downward directions and assists upward/downward movement of the hood portion 200. For this, it is preferable that the guide shafts 314 are provided in symmetrical positions about at least two main gears 313 to prevent the hood portion 200 from tilting on one side. The guide shaft 314 may have roughly the same length as the length of the main gear 313.

The guide portion 315 is fixedly arranged on the housing 110 of the cooking portion 100 and includes the main gear hole 315*a* and the guide shaft hole 315*b*.

The main gear hole 315*a* is rotatably engaged with the main gear 313. Screw threads, which correspond to screw threads formed on the outer periphery of the main gear 313, are formed on the inner periphery of the main gear hole 315*a* so that the main gear hole 315*a* ascends or descends as the main gear 313 is rotated. Accordingly, the main gear 313 is rotated simultaneously with ascending or descending in a state where it is engaged with the main gear hole 315*a* of the guide portion 315 that is in a fixed state, and thus can move the hood portion 200 to the first position or the second position.

The guide shaft 314 is slidably coupled to the guide shaft hole 315*b* in the upward/downward direction. Further, since a plurality of guide shafts 314 is provided, it is preferable that guide shaft holes 315*b*, the number of which corresponds to the number of guide shafts 314, are provided.

Referring to FIGS. 9 to 12, the second driving portion 320 changes the direction in which the hood portion 200 is directed, and includes a second driving source 321, a driving shaft 322, a first engagement portion 323, and a second engagement portion 324. In this case, the direction of the hood portion 200 is changed so that the angle of the suction port 201 against the cooking portion 100 is in the range of 0° to 90°. In addition, the direction of the hood portion 200 toward the cooking portion 100 is changed in both the second position and the third position.

The second driving source 321 generates a rotating power for changing the direction of the hood portion 200 toward the cooking portion 100 and transfers the generated rotating power to the driving shaft 322. As the second driving source 321, a typical motor is used.

The driving shaft 322 has one end that is connected to the second driving source 321 to receive the power from the second driving source 321, is rotatably engaged with a hole (not illustrated) that is formed roughly in the center of the first engagement portion 323, and is fixedly engaged with a hole (not illustrated) that is formed roughly in the center of the second engagement portion 324. Accordingly, the driving shaft 322 can be rotated against the first engagement portion 323, but cannot be rotated against the second engagement portion 324. Consequently, as the driving shaft 322 is rotated, the hood portion 200 can be rotated about the driving shaft 322 as a center shaft.

The first engagement portion 323 is arranged on end portions of the main gear 313 and the guide shaft 314, and the driving shaft 322 is rotatably engaged with the hole that is formed roughly in the center of the first engagement portion 323.

The second engagement portion 324 is formed to project from one side of the hood portion 200, and the driving shaft 322 is fixedly engaged with the hole that is formed roughly in the center of the second engagement portion 324.

The controller 400 makes the cooktop 120 in a cooking state in accordance with a user command that is input through the input portion 112 and changes the position of the hood portion 200 through driving of the driving portion 300. Further, the controller 400 controls the hood portion 200 to adjust the suction force of the suction port 201.

Hereinafter, the operation of the cooking device 1 as constructed above according to an embodiment of the present disclosure will be described.

Referring to FIG. 1, in the case where the user does not use the hood portion 200, the hood portion 200 is in the first position in which the hood portion 200 is accommodated in the housing 110 of the cooking portion 100. Accordingly, the user can secure a wide cooking space.

Then, referring to FIGS. 6 to 8, in the case where the user starts cooking food on the cooktop 120 of the cooking portion 100, the user controls the hood portion 200 to move to the second position through the input portion 112. In this case, the hood portion 200, which is accommodated in the cooking portion 100, is driven to ascend by the first driving portion 310 to move to the second position in which the hood portion 200 projects from the cooking portion 100.

Figure 9:
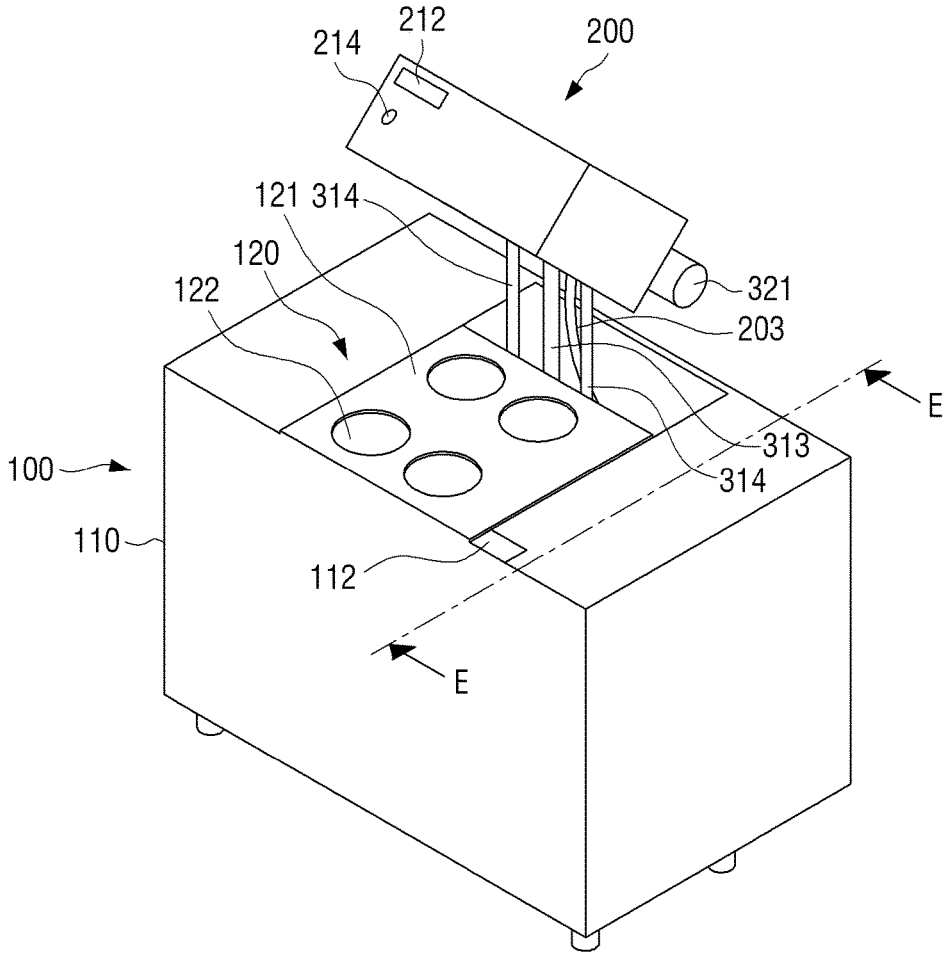
FIG. 9 illustrates a case where a hood portion of a cooking device according to a first embodiment of the present disclosure has a changed angle against a cooking portion in a second position according to the various embodiments of the present disclosure.
Figure 10:
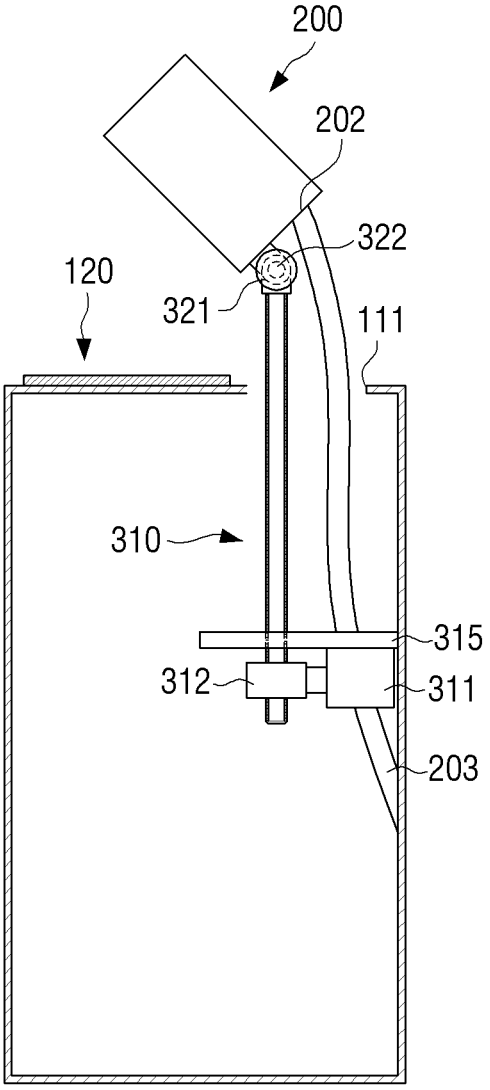
FIG. 10 illustrates a cross-sectional view taken along line E-E indicated in FIG. 9.
Figure 11:
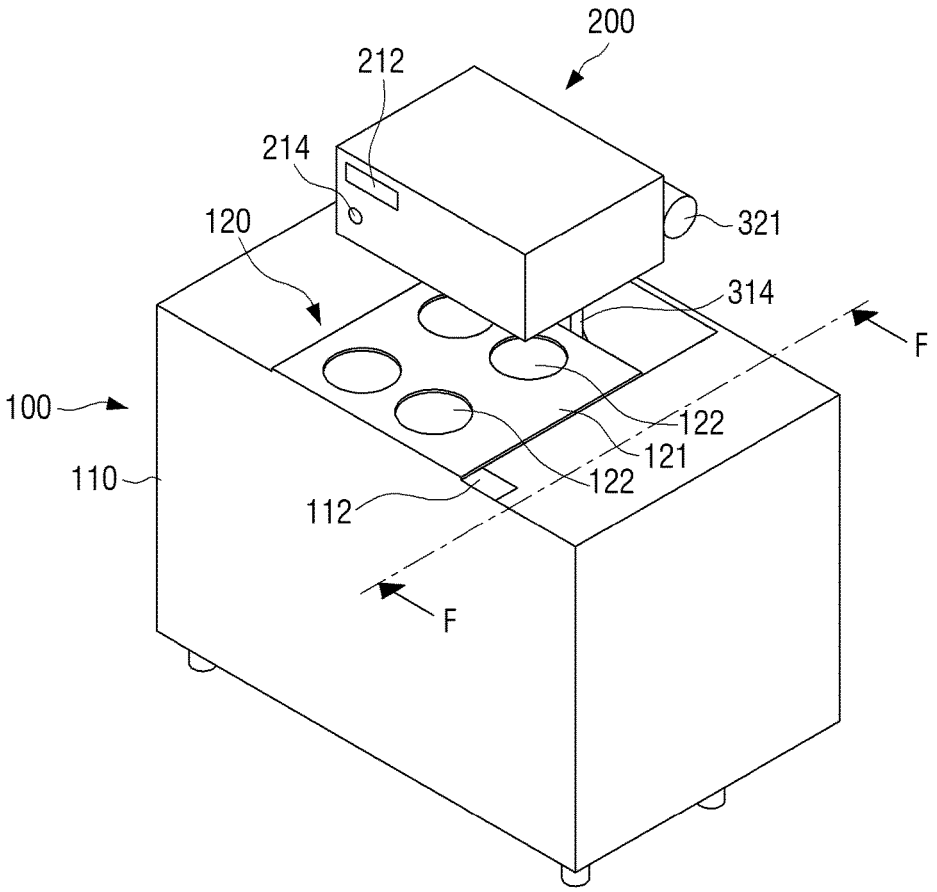
FIG. 11 illustrates a case where a hood portion of a cooking device according to a first embodiment of the present disclosure has a changed angle against a cooking portion in a second position according to the various embodiments of the present disclosure.
Figure 12:
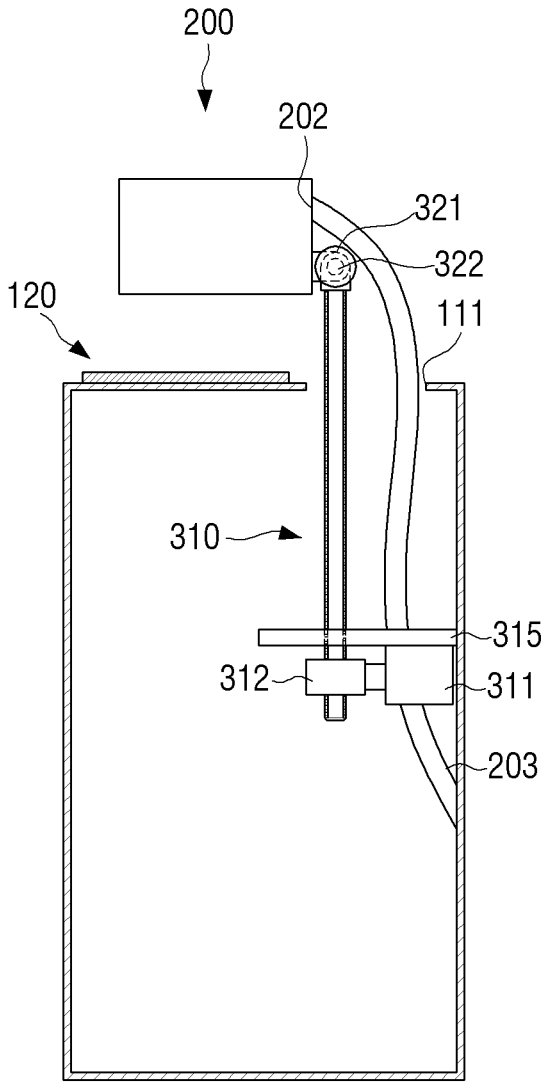
FIG. 12 illustrates a cross-sectional view taken along line F-F indicated in FIG. 11 according to the various embodiments of the present disclosure.

Then, the user controls the second driving portion 320 to adjust the angle of the hood portion 200 against the cooking portion 100 through the input portion 112. In this case, the angle of the hood portion 200 against the cooking portion 100 can be adjusted in consideration of the size of the cooking vessel. That is, the hood portion 200 moves to be tilted against the cooking portion 100 as illustrated in FIGS. 9 and 10 or moves to completely face the cooking portion 100 as illustrated in FIGS. 11 and 12.

Thereafter, once the use of the hood portion 200 is completed, the user controls the first and second driving portions 310 and 320 to move the hood portion 200 to the first position in which the hood portion 200 is accommodated in the cooking portion 100 through the input portion 112.

According to the above-described construction according to the present disclosure, the hood portion 200 can be hidden not to occupy a space when it is not in use, and thus space utilization can be heightened. In addition, the angle of the hood portion 200 against the cooking portion 100 can be variously changed, and thus the cooking smell and smoke can be efficiently inhaled corresponding to the cooking vessel.

Referring to FIGS. 14 to 17, a cooking device 2 according to a second embodiment of the present disclosure will be described. In describing the construction according to the second embodiment, the same reference numerals are given to a cooking portion 100 and a controller 400 that are the same as those according to the first embodiment as described above, and the detailed explanation thereof will be omitted. A hood portion 500 and a driving portion 600, which are different from those according to the first embodiment, will now be described.

According to the cooking device 2 according to the second embodiment of the present disclosure, the hood portion 500 and the driving portion 600 are arranged on the ceiling 10.

Figure 14:
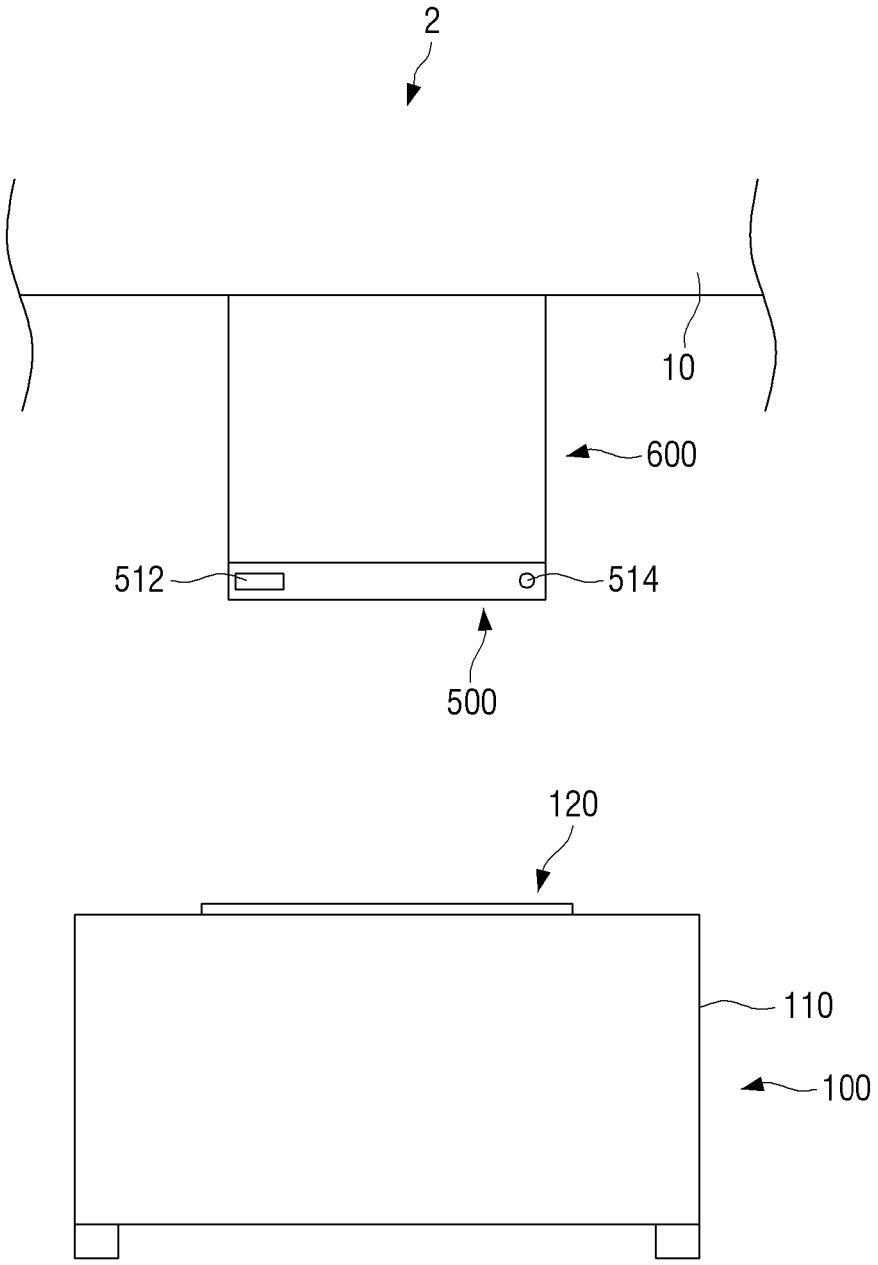
FIG. 14 illustrates a cooking device according to a second embodiment of the present disclosure.
Figure 15:
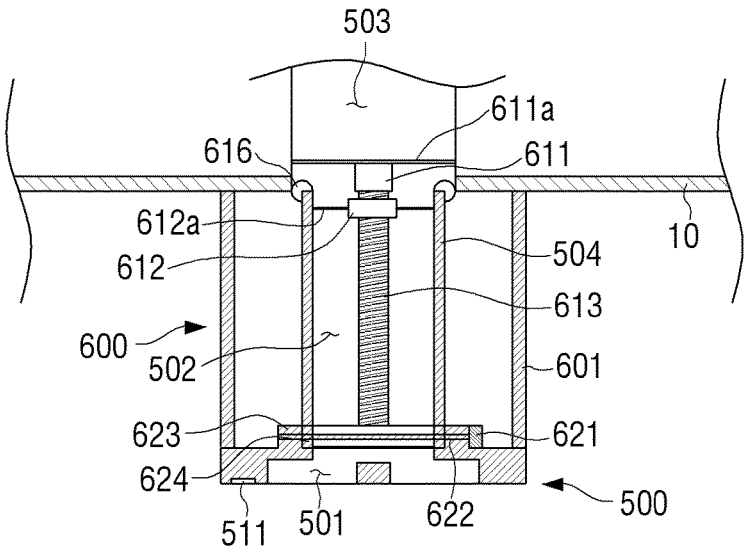
FIG. 15 illustrates a hood portion and a driving portion illustrated in FIG. 14 according to the various embodiments of the present disclosure.
Figure 15:
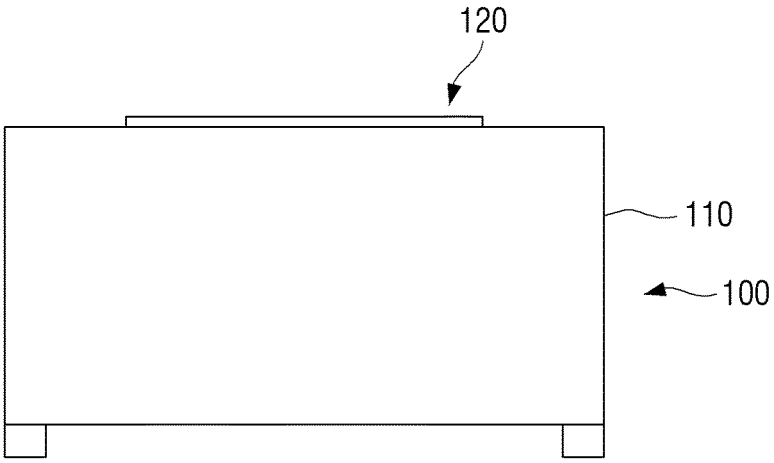
Figure 16:
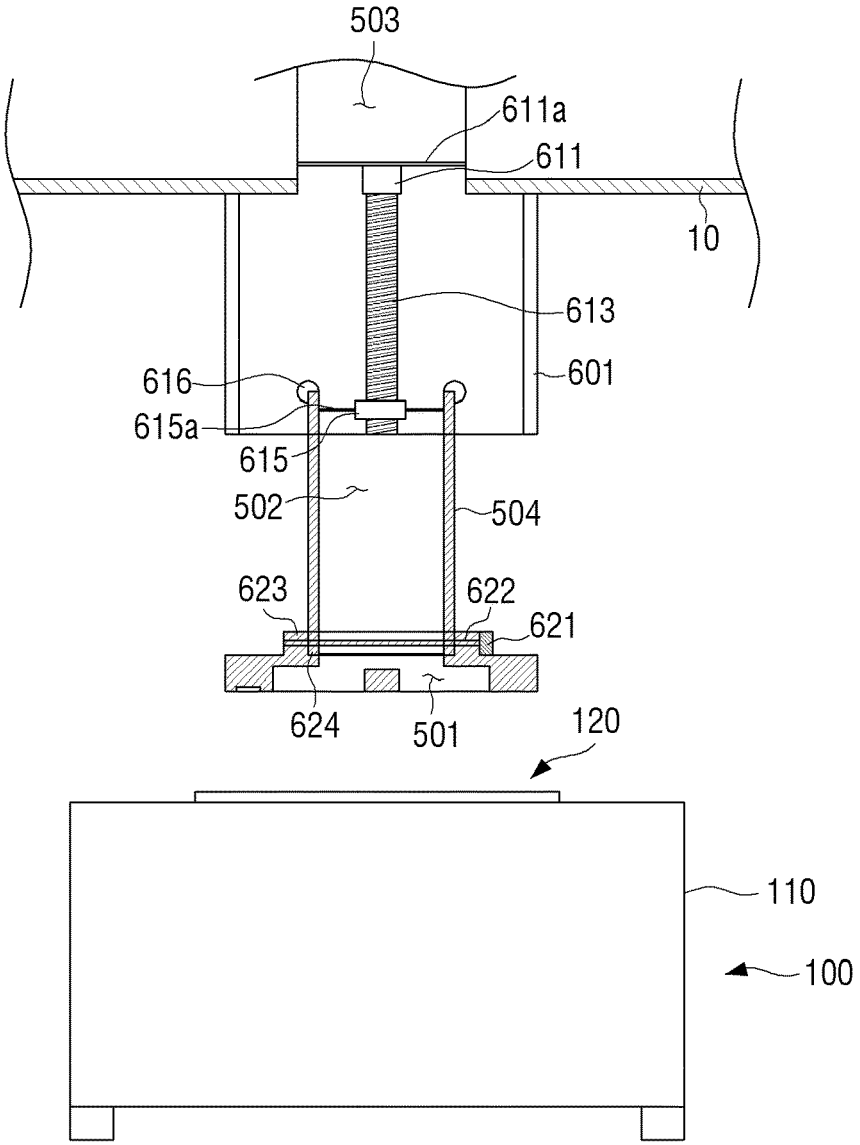
FIG. 16 illustrates a case where a hood portion illustrated in FIG. 15 is in a second position according to the various embodiments of the present disclosure.

In a standby mode in which a suction mode for inhaling cooking smell and smoke is not performed, the hood portion 500 is in a first position in which the hood portion 500 is arranged adjacent to one end portion of the ceiling 10 as illustrated in FIGS. 14 and 15, and in the suction mode, the hood portion 500 is in a second position in which the hood portion 500 is separated from the ceiling 10 and is arranged adjacent to the cooking portion 100 as illustrated in FIG. 16.

Specifically, the hood portion 500 is connected to the driving portion 600 to be described later to be movable to any one of the first position and the second position by the driving portion 600. The hood portion 500 includes a suction port 501, a communication port 502, a discharge port 503, an extended pipe 504, an illuminator 511, a display 512, a distance sensor (not illustrated), and a warning portion 514.

Referring to FIGS. 15 and 16, the suction port 501 is formed on one surface of the hood portion 500 that faces the cooking portion 10 to inhale the cooking smell and smoke generated from the cooktop 120. Since the suction port 501 is the same as the suction port 201 according to the first embodiment, the detailed explanation thereof will be omitted.

The communication port 502 makes the suction port 501 and the discharge port 503 communicate with each other, and moves the cooking smell and smoke that is inhaled from the suction port 501 to the discharge port 503. The communication port 502 is formed in the extended pipe 504.

The discharge port 503 is a place into which the cooking smell and smoke that is inhaled through the suction port 501 flows through the communication port 502, and discharges the inflow cooking smell and smoke to an outside. The discharge port 503 is connected to an exhaust port (not illustrated) that is penetratingly formed on the ceiling 10, and the exhaust port (not illustrated) guides the cooking smell and smoke to the outside.

In addition, on an air flow path that includes the suction port 501, the communication port 502, and the discharge port 503, a driving fan (not illustrated) is provided to generate a suction force in the suction port 501. Through the driving fan, the hood portion 500 can inhale and discharge the cooking smell and smoke generated from the cooktop 120 of the cooking portion 100 to the outside.

The extended pipe 504 forms the communication port 502, and a part of a first driving portion 610 is arranged in the extended pipe 504. The extended pipe 504 is arranged in a case 601 of the first driving portion 610.

In addition, one end portion of the extended pipe 504 is arranged adjacent to the ceiling 10, and a second engagement portion 624 to be described later is formed on the other end portion of the extended pipe 504 that is opposite to the one end portion. This will be described later.

Since the illuminator 511, the display 512, the distance sensor (not illustrated), and the warning portion 512 are the same as the illuminator 211, the display 212, the distance sensor 213, and the warning portion 214 as described above according to the first embodiment, the detailed explanation thereof will be omitted.

The driving portion 600 moves the hood portion 500, and includes a first driving portion 610 and a second driving portion 620.

Referring to FIG. 15, the first driving portion 610 moves the hood portion 500 to the first position and the second position, and includes a first driving source 611, a main gear 613, a guide portion 615, and a guide projection 616.

The first driving portion 611 generates a driving power to move the hood portion 500 to the first position and the second position, and is fixed to the inside of the discharge port 503 by a first driving source support member 611*a*.

The main gear 613 is rotatably engaged with the guide portion 615, and one end portion of the main gear 613 is connected to the first driving source 611 to receive the driving force that is transferred from the first driving source 611. As the main gear 613 as described above, a worm gear having screw threads that are formed along the outer periphery thereof is used. In this case, the main gear 613 is rotated at a standstill to move the guide portion 615 in upward/downward directions. In addition, in the same manner as the main gear 313 as described above according to the first embodiment, the main gear 613 can move the hood portion 500 to a third position that is between the first position and the second position in accordance with a user's intention.

The guide portion 615 is fixed to the extended pipe 504 by the guide portion support member 615*a*. The guide portion 615 is provided with a main gear hole (not illustrated) formed roughly in the center thereof and having an inner periphery on which screw threads that correspond to screw threads formed on the outer periphery of the main gear 613 are formed. Accordingly, the guide portion 615 is engaged with the main gear 613, and the main gear 613 is rotated simultaneously with moving upward and downward. The movement of the guide portion 615 is transferred to the hood portion 500 by means of the guide portion support member 615*a*. Accordingly, the hood portion 500 can move upward and downward between the first position and the second position.

The guide projection 616 is provided along the circumference of the one end portion that faces the discharge port 503 of the extended pipe 504, and when the hood portion 500 ascends and moves adjacent to the ceiling 10, the guide projection 616 guides the extended pipe 504 so that the extended pipe 504 does not secede from the position that corresponds to the discharge port 503.

Figure 17:
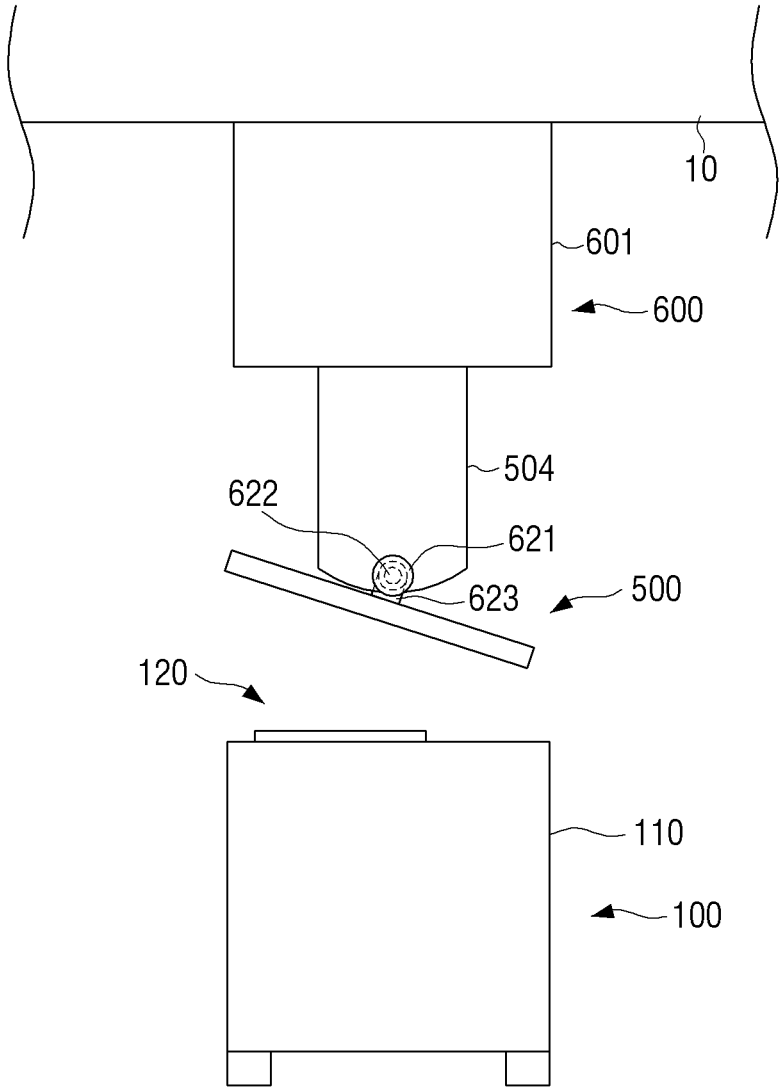
FIG. 17 illustrates a right side of the cooking device illustrated in FIG. 16 according to the various embodiments of the present disclosure.

Referring to FIGS. 16 and 17, the second driving portion 620 changes the direction in which the hood portion 500 is directed, and includes a second driving source 621, a driving shaft 622, a first engagement portion 623, and a second engagement portion 624. In this case, the direction of the hood portion 500 is changed in both the second position and the third position.

The second driving source 621 generates a rotating power for changing the direction of the hood portion 500 toward the cooking portion 100 and transfers the generated rotating power to the driving shaft 622. As the second driving source 621, a typical motor is used.

The driving shaft 622 has one end that is connected to the second driving source 621 to receive the power from the second driving source 621, is fixedly engaged with a hole (not illustrated) that is formed roughly in the center of the first engagement portion 623, and is rotatably engaged with a hole (not illustrated) that is formed roughly in the center of the second engagement portion 624. Accordingly, the driving shaft 622 cannot be rotated against the first engagement portion 623, but can be rotated against the second engagement portion 624. Consequently, as the driving shaft 622 is rotated, the hood portion 500 can be rotated about the driving shaft 622 as a center shaft.

The first engagement portion 623 is formed adjacent to the other end portion of the extended pipe 504 of the hood portion 500, and the driving shaft 622 is rotatably engaged with the hole that is formed roughly in the center of the first engagement portion 623.

Referring to FIG. 17, the second engagement portion 624 is formed on the other end portion of the extended pipe 504, and the driving shaft 622 is fixedly engaged with the hole that is formed roughly in the center of the second engagement portion 624. Further, two opposite surfaces of the second engagement portion 624 have a predetermined curvature so that they do not interfere with the hood portion 500 that is rotated about the driving shaft 622 to change the direction in which the hood portion 500 is directed to the cooking portion 100. In this case, it is preferable that the second engagement portion 624 is formed to be convex against the cooking portion 100.

Hereinafter, the operation of the cooking device 2 as constructed above according to the second embodiment of the present disclosure will be described.

Referring to FIGS. 14 and 15, in the case where the user does not use the hood portion 500, the hood portion 500 is in the first position in which the hood portion 500 is adjacent to the ceiling 10. Accordingly, the user can secure a wide cooking space.

Then, referring to FIG. 16, in the case where the user starts cooking food on the cooktop 120 of the cooking portion 100, the user controls the controller 400 to move the hood portion 500 to the second position through the input portion 112. In this case, the hood portion 500 is driven to descend from the position in which the hood portion 500 is adjacent to the ceiling 10 by the first driving portion 610 to move to the second position in which the hood portion 500 is arranged adjacent to the cooking portion 100.

Then, referring to FIG. 17, the user controls the second driving portion 620 to adjust the angle of the hood portion 500 against the cooking portion 100 through the input portion 112. In this case, the angle of the hood portion 500 against the cooking portion 100 can be adjusted in consideration of the size of the cooking vessel.

Thereafter, once the use of the hood portion 500 is completed, the user controls the first and second driving portions 610 and 620 to move the hood portion 500 to the first position in which the hood portion 500 is arranged adjacent to the ceiling 10 through the input portion 112.

According to the above-described construction according to the present disclosure, since the hood portion 500 does not occupy an upper space of the cooking portion 100 and is arranged adjacent to the ceiling 10 to secede from the user's field of view when it is not in use, space utilization can be heightened and a fine sight can be presented. In addition, since the angle of the hood portion 500 against the cooking portion 100 can be variously changed, the cooking smell and smoke can be efficiently inhaled corresponding to the cooking vessel.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A cooking device comprising:

a cooking portion;

a hood portion arranged on the cooking portion and provided with a suction port formed on one side thereof; and a driving portion configured to move the hood portion, wherein the hood portion is movable to any one of a first position in which the hood portion is accommodated in the cooking portion and a second position in which the hood portion projects vertically from the cooking portion, and wherein an angle of the suction port is varied so as to change a direction in which the suction port is directed in the second position, wherein the driving portion comprises a first driving portion configured to move the hood portion to the first position, and wherein the first driving portion comprises:

a driving source configured to generate a driving power, a worm gear disposed at a center of the hood portion, and configured to receive a driving power that is transferred from a driving source and to move the hood portion, at least two guide shafts provided in symmetrical positions about the worm gear, and a guide portion includes a worm gear hole configured to rotatably engaged with the worm gear and guide shaft holes configured to slidably coupled with guide shafts, wherein the driving portion further comprises a second driving portion configured to generate a rotating power to change the angle of the suction port against the cooking portion between a position vertically extended from the guide shafts and a position perpendicular to the guide shafts.

2. The cooking device as claimed in claim 1, wherein an angle of the suction port of the hood portion against the cooking portion is changed in a range of 0° to 90°.

3. The cooking device as claimed in claim 1, wherein the hood portion is hingedly connected to a part of the driving portion.

4. The cooking device as claimed in claim 1, wherein the hood portion is movable to a third position that is between the first position and the second position.

5. The cooking device as claimed in claim 4, wherein the angle of the hood portion is varied so as to change the direction in which the suction port is directed in the third position.

6. The cooking device as claimed in claim 1, wherein the hood portion is provided with a distance sensor arranged adjacent to the suction port to measure a distance between the suction port and a cooking vessel that is put on the cooking portion, and the distance sensor comprises a warning portion configured to warn a user when the distance between the suction port and the cooking vessel reaches a predetermined distance.

7. The cooking device as claimed in claim 6, wherein the warning portion is a display or a sound portion.

8. The cooking device as claimed in claim 6, wherein the hood portion further comprises a display configured to display the distance between the suction port and the cooking vessel, which is measured by the distance sensor, to the user.

9. The cooking device as claimed in claim 1, wherein the cooking portion further comprises a cover configured to cover the hood portion so that the hood portion is not exposed to an outside when the hood portion is in the first position.

10. The cooking device as claimed in claim 1, wherein the hood portion further comprises an illuminator arranged toward the cooking portion.

11. The cooking device as claimed in claim 1, wherein a suction force at the suction port is adjustable.

12. A cooking device comprising:

a cooking portion;

a hood portion provided with a suction port formed on one side thereof and configured to be movable to any one of a first position in which a suction mode for inhaling polluted air that is generated from the cooking portion through the suction port is not performed and a second position in which the suction mode is performed; and a driving portion configured to move the hood portion, wherein an angle of the hood portion is varied so as to change a direction in which the suction port is directed in the second position, wherein the hood portion is arranged on a ceiling, is positioned adjacent to the ceiling in the first position, and descends by the driving portion to move to the second position in which the hood portion is adjacent to the cooking portion, and wherein the driving portion includes a first driving portion configured to move the hood portion vertically to the first position and the second position and a second driving portion configured to change the direction in which the suction port is directed, and wherein the first driving portion comprises:

a driving source configured to generate a driving power, a worm gear disposed at a center of the hood portion, and configured to receive a driving power that is transferred from a driving source and to move the hood portion, at least two guide shafts provided in symmetrical positions about the worm gear, and a guide portion includes a worm gear hole configured to rotatably engaged with the worm gear and guide shaft holes configured to slidably coupled with guide shafts, wherein the second driving portion comprises a second driving portion configured to generate a rotating power to change the angle of the suction port in relation to the guide shafts.

13. The cooking device as claimed in claim 12, wherein an angle of the suction port of the hood portion against the cooking portion is changed in a range of 0° to 90°.

14. The cooking device as claimed in claim 12, wherein the hood portion is movable to a third position that is between the first position and the second position.

15. The cooking device as claimed in claim 12, wherein the angle of the hood portion is varied so as to change the direction in which the suction port is directed in a third position.

16. The cooking device as claimed in claim 12, wherein the hood portion is provided with a distance sensor arranged adjacent to the suction port to measure a distance between the suction port and a cooking vessel that is put on the cooking portion, and the distance sensor comprises a warning portion configured to warn a user when the distance between the suction port and the cooking vessel reaches a predetermined distance.

* * * * *